United States Patent [19]

Bergermann et al.

[11] Patent Number: 4,528,560

[45] Date of Patent: Jul. 9, 1985

[54] METHOD OF CURSOR CONTROL FOR ENABLING ALL TEXT IN WORKING MEMORY TO BE DISPLAYED WELL IN ADVANCE OF REPRODUCTION OF EDITING

[75] Inventors: Franz Bergermann, Fürth; Michael Prüfer, Cadolzburg, both of Fed. Rep. of Germany

[73] Assignee: Triumpf-Adler A.G. für Büro und Informationstechnik, Nuremberg, Fed. Rep. of Germany

[21] Appl. No.: 685,608

[22] Filed: Dec. 27, 1984

Related U.S. Application Data

[63] Continuation of Ser. No. 437,901, Nov. 1, 1982, abandoned.

[30] Foreign Application Priority Data

Dec. 24, 1981 [DE] Fed. Rep. of Germany ..... 3151357

[51] Int. Cl.[3] ..... G09G 3/00

[52] U.S. Cl. ..... 340/709; 340/792; 340/748; 364/523; 400/63; 400/83

[58] Field of Search ..... 340/709, 724, 792, 748, 340/749, 750; 364/522, 523; 400/279, 280, 63, 83

[56] References Cited

U.S. PATENT DOCUMENTS

| | | | |
|---|---|---|---|
| 3,618,032 | 11/1971 | Goldsberry et al. | 400/63 |
| 3,654,609 | 4/1972 | Bluethman et al. | 400/83 |
| 4,360,806 | 11/1982 | von Knorre et al. | 340/792 |
| 4,389,641 | 6/1983 | Nakanishi et al. | 340/792 |
| 4,408,302 | 10/1983 | Fessel et al. | 400/83 |
| 4,439,838 | 3/1984 | Klingenberg | 400/83 |

*Primary Examiner*—Gerald L. Brigance

*Attorney, Agent, or Firm*—Joseph R. Spalla

[57] ABSTRACT

A method for controlling a cursor of a one-line display device in a text writing equipment, where a text stored in a working memory of the text writing equipment can be displayed on the display device. The one-line display device is divided into three zones, in each of which a different control of the cursor is effected. In the first zone, comprising a plurality of display positions, the cursor works as a movable mark, i.e., after each cursor shift command or after each reproduce command, a cursor movement occurs with the displayed text standing still. When the cursor reaches the second zone of the display device, which is operator selectable, there occurs before each further cursor movement ordered by cursor shift commands or reproduce commands, a check to determine whether the last symbol stored in the working memory is displayed on the display. If not, a displacement of the displayed text occurs while the cursor remains stationary. If the last symbol in working memory is displayed, the cursor is moved into the third display zone comprising a plurality of display positions, where it again operates as movable mark with the displayed text stationary.

3 Claims, 8 Drawing Figures

METHOD OF CURSOR CONTROL FOR ENABLING ALL TEXT IN WORKING MEMORY TO BE DISPLAYED WELL IN ADVANCE OF REPRODUCTION OF EDITING

This is a continuation of application Ser. No. 437,901, filed Nov. 1, 1982 now abandoned.

This invention relates to text writing machines having a line display for displaying text stored in memory; more particularly it relates to a text writing machine having a cursor for indicating the point in a displayed text to be reproduced or edited as by corrections, insertions or deletions; and specifically it relates to a text writing machine having a cursor control and to a method for controlling a cursor which optimizes the display of past, present and future text stored in memory before reproduction or editing.

In textwriters, particularly for text handling and processing, it is customary to provide a line display for displaying a text portion, e.g. a standard line or a part thereof. The user is thus given the possibility to take a look, as it were, into the working memory of the equipment.

In reproducing and, in particular, in correcting text, and also for making insertions or deletions in text, it is necessary to indicate to the operator by means of a mark, generally referred to as cursor, which symbol is in line for processing at the moment. Different methods have become known for this purpose.

German patent application DE-OS No. 29 15 673 now corresponding U.S. Pat. No. 4,408,302 discloses a display device which comprises a stationary cursor 15 located in the central region of the display device 11. This immobile cursor represents the symbol input position when text is entered via a keyboard, and during reproduction of text in working memory the position of the symbol being handled or to be reproduced at the time. Such a display device has the disadvantage that upon reproduction of a text the symbol stored under the first memory address of the working memory appears, when reproduction begins, at the point which is marked by the stationary cursor. This means that a portion of the display remains unused, owing to which the information maximally representable in the display device is unnecessarily curtailed.

Another method of letting the operator know at which position of the display the next symbol input will take place, or respectively which symbol represented on the display will be handled next during reproduction, is disclosed in DE-OS No. 28 01 749. The line display described therein uses, as is customary also for picture screen-oriented text handling and processing equipment, a movable cursor, to offer the operator the possibility to identify the input position or the next symbol to be processed. Upon reproduction of a text from memory, the symbol stored under the first memory address is here normally represented at the left edge of the display, followed by symbols stored in next following addresses, until the display capability of the display device is exhausted. Identifying the symbol in line for processing is done, as has been mentioned, by means of a cursor which, after reproduction of a symbol is completed, is shifted to the right by one position thus to indicate the next symbol to be reproduced. When the cursor has been shifted in this manner to the right-hand edge of the line display, subsequent commands to reproduce text results in a shift of the display to the left by one position each time.

With such a display method, following movement of the cursor to the last position at the right-hand edge of the display, the operator is unable to see more than one symbol of the text still to be reproduced. This is a serious disadvantage especially when corrections, insertions or deletions in texts are to be carried out which contain identical or similar text portions.

In accordance with the invention there is provided a method for controlling a cursor such that all text symbols in a working memory are displayed well in advance of processing, e.g. reproduction or editing. The method comprises indexing said cursor from the first position on the display toward the last position on the display in response to cursor control, e.g. reproduce or edit commands, establishing a given display position intermediate said first and last display positions, determining when said cursor has reached said given position whether the last symbol in working memory appears on said display, holding said cursor at said given position if the last symbol in working memory does not appear in said given or subsequent positions on the display, thereafter while the cursor is held at said given position shifting the display toward the first display position in response to reproduce commands until it is determined that said last symbol in working memory appears in the last display position, and indexing said cursor toward said last position subsequent to determining that said last symbol in working memory appears on said display.

Thus in accordance with the invention in handling text stored in the working memory of a text writing equipment, the display of the text portion to be handled occurs in a one-line display such that automatically an optimum combination of "past, present, and future of the text" is always displayed, thereby greatly facilitating the identification of a text portion to be handled. A further advantage is to be seen in that by the movement of the cursor, or respectively by its standing still, the operator receives information on what portion of the stored text text handling is taking place in.

It is therefore the object of the invention, while avoiding the disadvantages mentioned, to provide a method for cursor control which makes it possible to display to an operator the maximum possible volume of information about the text stored in the working memory so that unambiguous identification of displayed text passages to be handled is facilitated.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
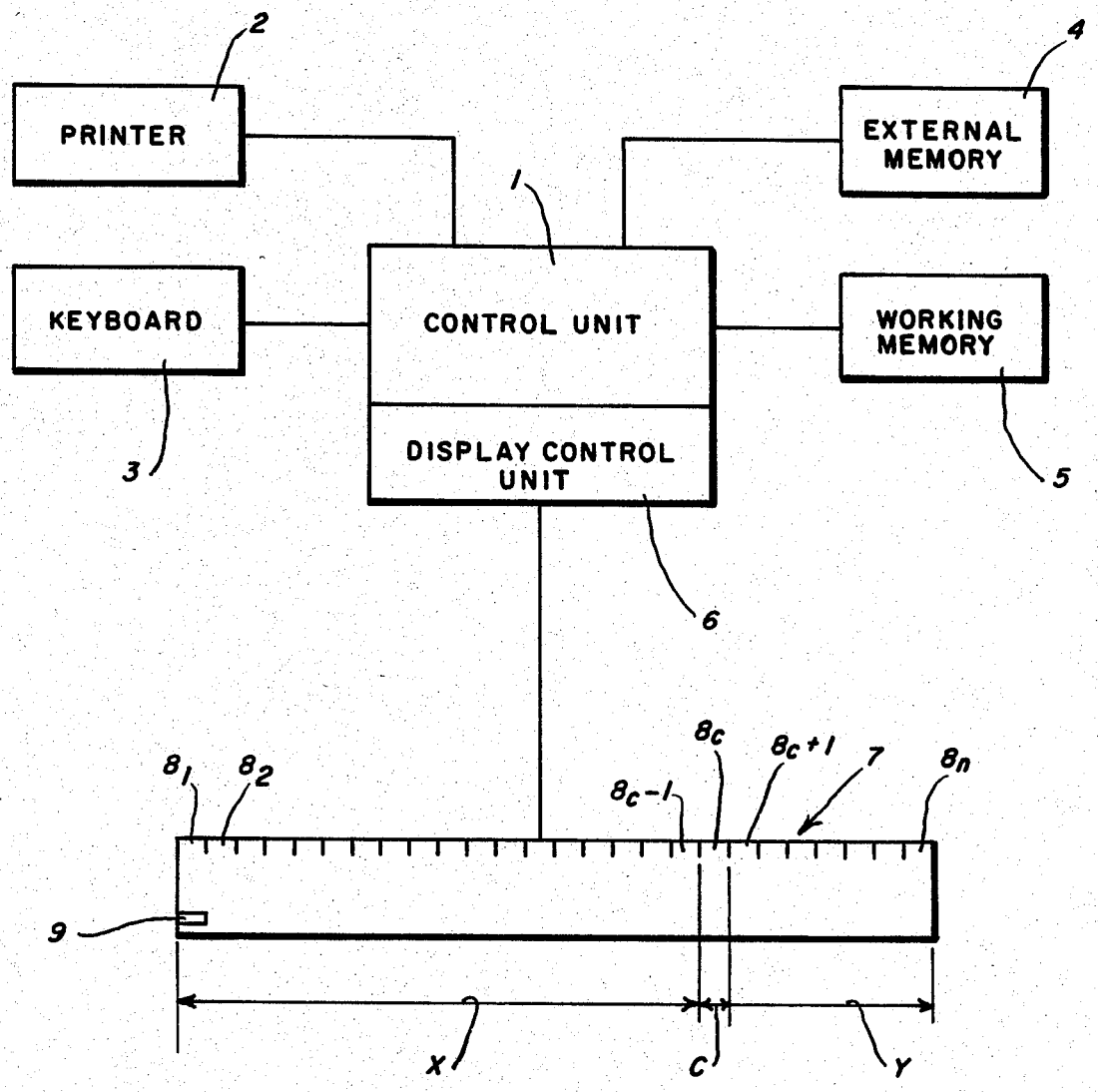
FIG. 1 is a block diagram of a text writing machine.

Referring now to FIG. 1 there is shown a block diagram of the construction of a text writing machine capable of text handling and processing comprising a control unit 1 to which a printer 2, a keyboard 3, an external memory 4, and a working memory 5 is connected. A display control unit 6, which may be part of control unit 1 is connected to a display device 7. The display device 7 comprises a plurality of display positions $8_1$–$8_n$ and is divided into three zones X, C, Y, in each of which a different control of a cursor 9 is effected. In the first zone X, the cursor 9 is controlled so that it functions as a variable cursor. The next following zone C defines a given display position $8_c$ whose location on the display device 7 can be selected or established from the keyboard 3. At position $8_c$ the cursor 9 is held stationary until all text in working memory appears on the display. In zone Y, which extends from zone C or position $8_c$ to the end or last position of the display device 7, the cursor 9 is again used as a variable cursor. The identification of the three different zones is effected via the display control unit 6.

Figure 2:
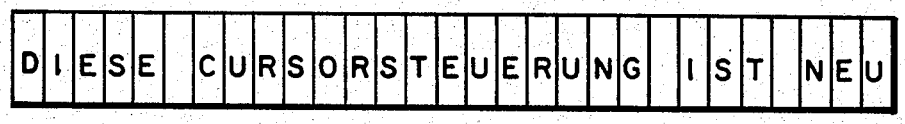
FIG. 2 is an illustration of a text stored in the working memory of the text writing machine; and FIGS. *3a–3f* are representations of text stored in working memory displayed on the display device of the text writing machine.
Figure 3A:
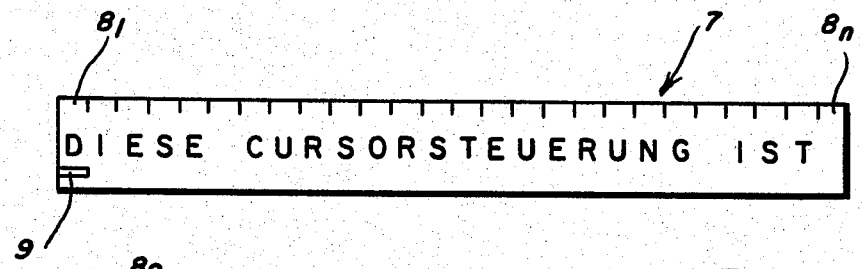
Figure 3B:
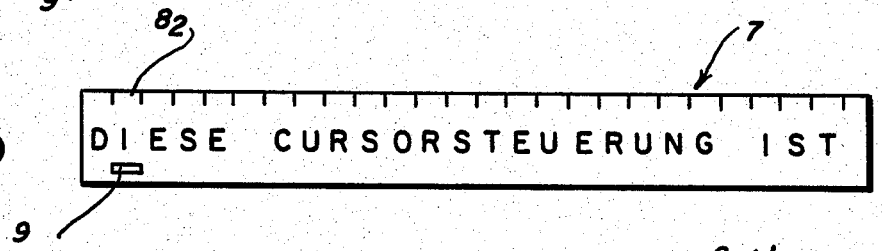
Figure 3C:
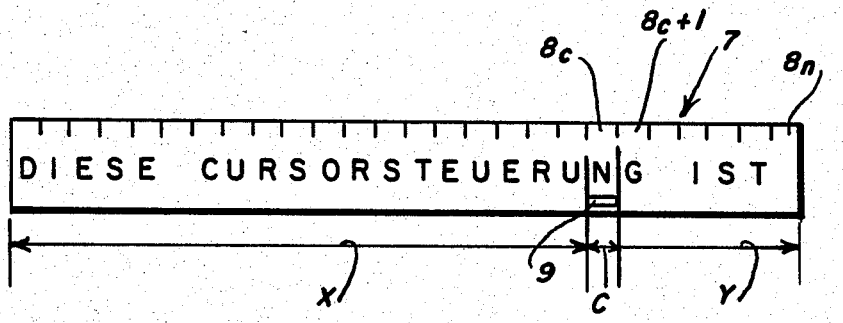

To explain the method of cursor control according to the invention more specifically, is is assumed in the following that the text shown in FIG. 2, which is deposited in encoded form in the working memory 5 of FIG. 1, is to be reproduced. FIG. 3*a* shows the display device 7 on which, at the display positions $8_1$–$8_n$, a portion of the text of FIG. 2 deposited in the working memory 5 (FIG. 1) is displayed. To reproduce this displayed text, the cursor 9 is located at first on the first display position $8_1$ of the display device 7. After completed reproduction of the symbol visible at the first display position 8, in response to a reproduce command, the cursor 9 is indexed or shifted to the right by one display position and hence points to the second display position $8_2$ or to the second symbol to be reproduced, as illustrated in FIG. 3*b*. The shift of cursor 9 by one position occurs after each reproduction process takes place until the cursor 9 has left the zone marked X of the display device 7 and is positioned in the zone marked C, and thus is visible at the display position $8_c$ as illustrated in FIG. 3*c*. From this point, before each subsequent reproduction process, the display control unit 6 determines whether the last symbol deposited in the working memory 5 is displayed in zone C or Y, that is, at the display positions $8_c$ and $8_{c+1}$–$8_n$, respectively, of the display device 7.

Figure 3D:
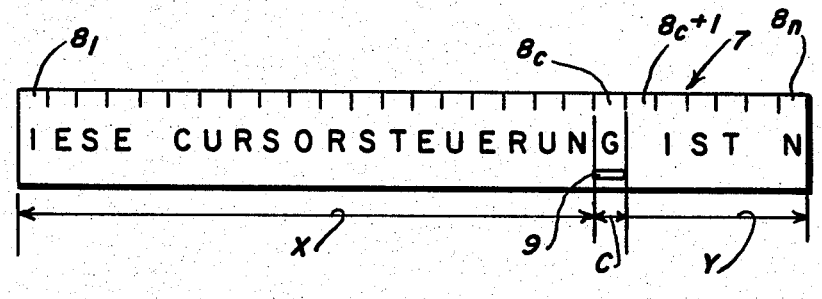

If it is determined that the last symbol deposited in the working memory 5 has not yet been displayed (this case is shown in FIG. 3*c*) the text represented on the display positions $8_1$–$8_n$ is shifted to the left by one display position in response to each subsequent reproduction, as shown in FIG. 3*d*, whereby the symbol displayed at the first display position $8_1$ before the reproduction process disappears and a new symbol appears at the last display position $8_n$. In this text shifting process, the cursor 9 is retained at the display position $8_c$, so that thereafter it points to the next symbol to be reproduced. Before the command for the next reproduction process the display control unit 6 again checks to determine whether the last symbol deposited in the working memory 5 is displayed at the display positions $8_c$ and $8_{c+1}$–$8_n$, respectively.

Figure 3E:
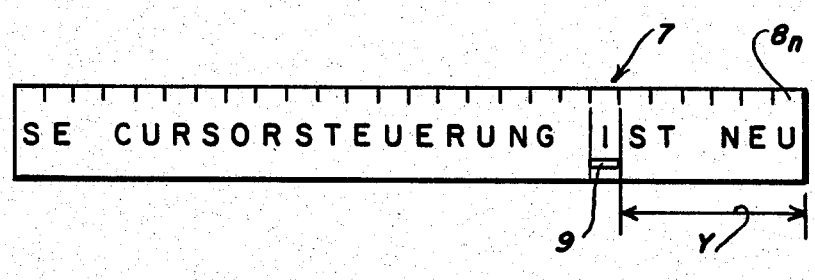
Figure 3F:
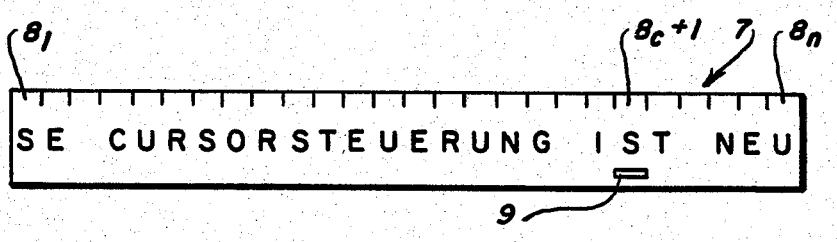

If the last symbol residing in working memory 5 id displayed in display position $8_n$, as shown in FIG. 3*e*, the cursor 9 is shifted from position $8_c$, after completed reproduction, to the right by one display position to position $8_{c+1}$, as shown in FIG. 3*f*, while the text represented on the display device 7 at the display positions $8_1$–$8_n$ remains stationary. In further reproduction processes the cursor 9 moves to position $8_n$.

The cursor control responsive to reproduction commands described above is also responsive to commands for the displacement of the cursor on the display. With the cursor functioning in zones X and Y as a variable cursor and in zone C as a fixed mark.

In the case that the cursor is located in zone C of the display device 7 and a cursor displacement to the left into zone X is to be effected, checks are made before the shifting process whether the symbol deposited under the first address of the working memory 5 is displayed at the first display position $8_1$. If it is not displayed the displayed text is shifted to the right relative to the stationary cursor 9 by one display position; if it is displayed, the cursor 9 moves to the left by one position in response to shift commands.

The term "symbol" as used herein may be a letter or character, a space, or a functiion, e.g. a line shift. Also it should be noted that the method according to the invention is not limited to display writing which reads from left to right, as shown in the embodiment. For writing which reads from right to left, the display device 7 illustrated in FIGS. 1 and 3*a* to 3*f* must simply be conceived mirrored on the right side, and the direction references "right" and "left" must be interchanged in the respective description.

With the method for cursor control of a one-line display device according to the invention it is possible, as is evident from the above explanations, to convey to the operator of a text writing equipment containing such a display device an optimum volume of information about a text deposited in the working memory of the text writing equipment which is, e.g., to be reproduced.

We claim:

1. In a text writing machine having a working memory for storing symbols of a text and a line display for displaying, in order, a predetermined number of the text symbols stored in said working memory, and having a display control unit for generating a cursor to sequentially indicate the positions on the display containing text symbols to be processed in response to a cursor control command, a method for controlling said cursor to enable all of the symbols stored in said working memory to be displayed comprising the steps of, indexing said cursor from the first position on the display toward the last position on the display in response to cursor control commands, establishing a given display position intermediate said first and last display positions, determining when said cursor has reached said given position, determining whether the last symbol of text stored in working memory appears on said display, continuing indexing of said cursor, responsive to said cursor control commands, to said last position if the last symbol in working memory appears on said display, and holding said cursor at said given position if the last symbol in working memory does not appear on the display, and shifting the displayed symbols toward the first display position in response to subsequent cursor control commands until it is determined that said last symbol in said working memory appears in the last display position, and then resuming indexing said cursor said last position in response to subsequent cursor control commands.

2. The method recited in claim 1, wherein said given position on said display is selectable.

3. The method recited in claim 1, said cursor indexing from said first to last position being from left to right.

* * * * *